United States Patent [19]

Kitatani

[11] 4,057,353

[45] Nov. 8, 1977

[54] FLOOR CLEANING DEVICE

[76] Inventor: Tatsuyuki Kitatani, No. 867, Fukuda, Sakai, Osaka, Japan

[21] Appl. No.: 685,164

[22] Filed: May 11, 1976

[30] Foreign Application Priority Data

Dec. 18, 1975 Japan ..... 50-172962[U]

[51] Int. Cl.[2] ..... A46B 11/06

[52] U.S. Cl. ..... 401/43; 401/46; 401/204; 401/289

[58] Field of Search ..... 401/42, 43, 289, 46, 401/203, 204

[56] References Cited

U.S. PATENT DOCUMENTS

| | | | |
|---|---|---|---|
| 1,051,328 | 1/1913 | Harnes et al. | 401/289 X |
| 1,277,805 | 9/1918 | Wingers | 401/289 |
| 2,708,599 | 5/1955 | Grikscheit | 401/43 X |
| 2,797,132 | 6/1957 | Alpert | 401/46 X |
| 3,161,905 | 12/1964 | Dryden | 401/204 |
| 3,271,809 | 9/1966 | Morawski | 401/43 X |

*Primary Examiner*—Stephen C. Pellegrino
*Attorney, Agent, or Firm*—Wenderoth, Lind & Ponack

[57] ABSTRACT

A floor cleaning device which includes a handle of hollow pipe, one end of which is connected to a hose for supplying water, and a polishing head detachably connected to the other end thereof. The middle portion of the hollow pipe is divided into two flow passages by means of a partitioning. A valve is mounted in the upper end portions of the flow passages so as to selectively block either of them, and a net is stretched at the lower end of one of the flow passages. The polishing head has a brush or sponge for cleaning the floor and has plural holes communicating with the hollow pipe so as to supply the brush or sponge with water.

5 Claims, 5 Drawing Figures

FLOOR CLEANING DEVICE

The present invention relates to a floor cleaning device.

BACKGROUND OF THE INVENTION

When cleaning the floor of a kitchen of a hotel, restaurant and the like, generally the cooperation of three persons who individually perform sprinkling water, scattering powder cleanser and brushing the floor is required. If the work is performed by a single person, it requires three times the labour and time.

An object of the present invention is to reduce this labour, and to provide a cleaning device which performs the three functions of sprinkling water, scattering cleanser and brushing or polishing the floor so as to greatly increase the cleaning efficiency.

BRIEF DESCRIPTION OF THE DRAWINGS

Other objects and features of the invention will be apparent from the following description of the invention with reference to the accompanying drawings, in which.

DETAILED DESCRIPTION OF THE INVENTION

Figure 1:
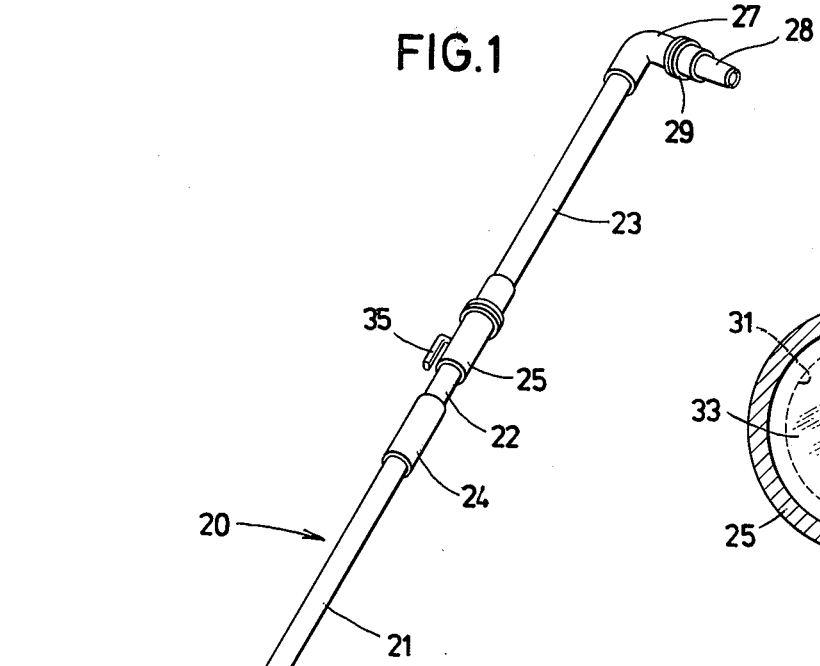
FIG. 1 is a perspective of the cleaning device of the invention.

Throughout the drawings, similar parts and elements are shown by the similar reference numerals.

Referring now to FIG. 1, the cleaning device of the invention generally comprises a brushing or polishing head 10 and a handle 20 of hollow pipe extending from said head 10. The handle 20 has a length suitable for a height of a person operating the cleaning device of the invention.

Figure 2:
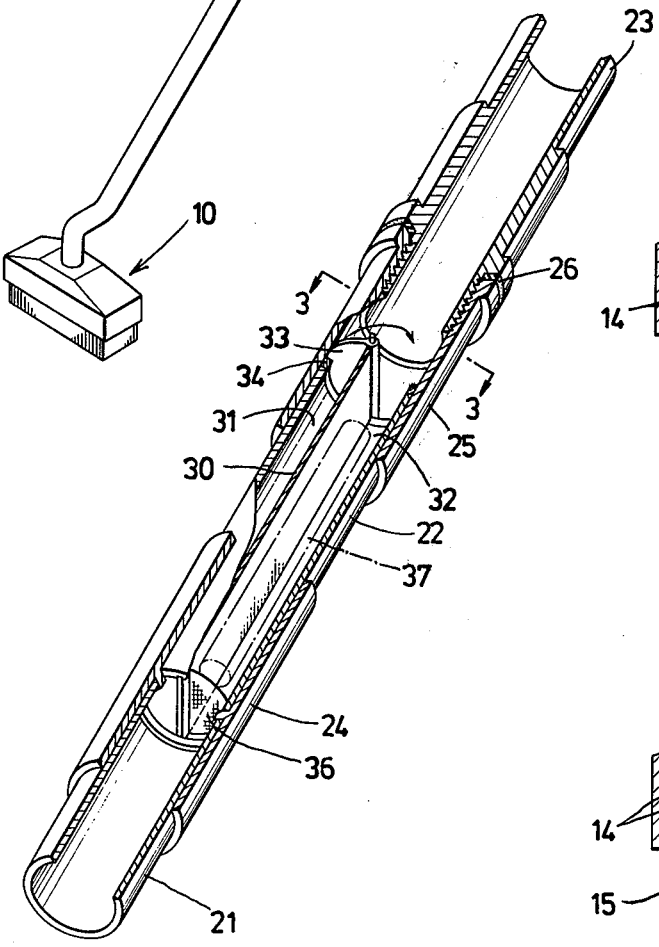
FIG. 2 is an enlarged perspective view, partially broken away, of the main part of the handle of the cleaning device.

Said handle 20 comprises a first pipe 21, a second pipe 22 and a third pipe 23 communicating with each other. The first pipe 21 is securely connected to the second pipe 22 by means of a sleeve 24. The third pipe 23 is threaded in a sleeve 25 which is fixed about the upper portion of the second pipe 22, as best seen in FIG. 2. By rotating the third pipe 23, it can be released from the second pipe 22. Preferably, a packing 26 is mounted about the threaded end of the third pipe 23. To the upper end of the pipe 23 is rotatably connected an elbow 27 which is detachably connected to a water supply hose 28 by means of a fitting 29.

Figure 3:
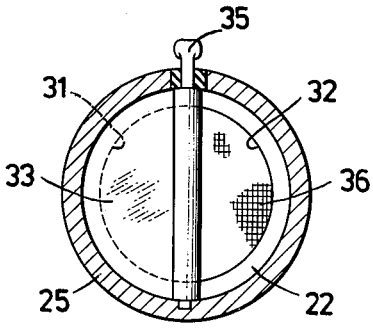
FIG. 3 is an enlarged transverse section substantially along the line 3—3 of FIG. 2.

As appears from FIGS. 2 and 3, the second pipe 22 is divided in its lengthwise direction by means of a partition 30 into two flow passages 31 and 32. At the upper end of the partition 30, a semi-circular valve 33 is pivoted in such a manner that either the passage 31 or 32 is blocked by the valve 33 when seated on an annular valve seat 34 mounted about the upper end of the second pipe 22. The pivot of the valve 33 is connected to a switching pin 35 liquid-tightly extending through the sleeve 25 for the rotation of the valve 33.

The lower end of the passage 32 is defined by a net 36 serving to prevent a rod-like soap 37 from falling into the first pipe 21.

Figure 4:
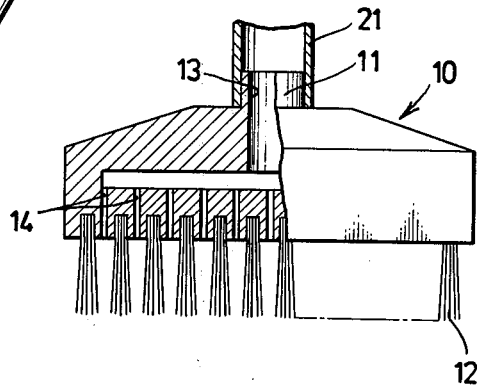
FIG. 4 is an enlarged front view, partially broken away, of a brushing or polishing head of the cleaning device.
Figure 5:
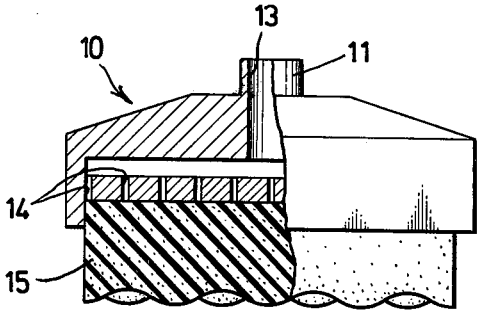
FIG. 5 is an enlarged front view, partially broken away, showing a slight modification of the brushing head of FIG. 4.

To the lower end of the first pipe 21 is detachably connected the brushing or polishing head 10 having a cylindrical projection 11 inserted into the lower end of the pipe 21 and a brush 12 planted in the lower face of the head 10, as best seen in FIG. 4. A passage 13 extending through said cylindrical projection 11 and communicating with the pipe 21 is provided in the head 10. Plural holes 14 communicating with said passage 13 is provided in the head 10 so as to open at the lower face of the head 10. Instead of the brush 12, a sponge or foam rubber 15 may be mounted on the lower end of the head 10, as shown in FIG. 5.

In operation, initially the third pipe 23 is released from the sleeve 25, and an easily soluble rod-like soap is inserted in the passage 32. The third pipe 23 is thereafter connected to the sleeve 25.

The valve 33 is then rotated by the pin 35 so as to block the passage 31 and to open the passage 32 having therein the soap 37. Thereafter the hose 28 is connected to the supply source of water, whereby the water with the soap flows out of the holes 14 of the brushing head 10.

By gripping the handle 20, the brushing or polishing head 10 is slid along the surface of a floor, thereby effecting the soap cleaning or polishing thereof.

After cleaning, the valve 33 is rotated so as to open the passage 31 and to close the passage 32. Then solely the water flows out of the holes 14 of the brushing head 10, thereby enabling the final water-washing of the floor.

According to the present invention as described above, there can be effected simultaneous operation of both brushing or polishing and sprinkling or scattering the soap and water, thereby enabling the reduction of labour as well as time.

Furthermore, after the soap cleaning, by changing the valve 33, solely the water is supplied, and the final water washing can be performed without the necessity of sprinkling water.

Therefore, the cleaning device of the invention has a wide usage not only for floor of a restaurant, hotel or other buildings but also for washing a deck of a ship, motor car or truck and the like.

If required, the handle 20 may be shortened to make smaller the dimensions of the cleaning device so as to be useful as a household cleaning device for washing off a toilet, bath room and the like.

What is claimed is:

1. A floor cleaning device connected to a water supply by a hose, comprising:

a hollow pipe handle connected at one end to said hose;

a partition at a midway portion of said pipe handle dividing said pipe into two flow passages;

flap means positioned at said partition and pivotable back and forth on both sides of said partition for alternatively closing off one of said flow passages in said pipe;

pipe means connected to said flap means and extending through said hollow pipe in a water-tight relationship for pivoting said flap means back and forth across said passages;

a screen stretched across the downstream end of one of said flow passages at said partition; and polishing means removably connected to the end of said hollow pipe handle opposite the end connected to said hose for cleaning the floor surface to be cleaned, said polishing means having a plurality of holes therethrough communicating with said hollow pipe, whereby water in said pipe will pass through said holes.

2. A device as claimed in claim 1 wherein said polishing means is comprised of a brush having holes therethrough.

3. A device as claimed in claim 1 wherein said polishing means is comprised of a polishing head connected to said hollow pipe; a plate having a plurality of holes therethrough mounted within said head; and a sponge attached to said plate on the side thereof opposite said hollow pipe.

4. A device as claimed in claim 1 wherein said hollow pipe handle is comprised of two pipe sections threaded together above said partition forming said fluid passages.

5. A device as claimed in claim 1 further comprising a rotatable elbow pipe connected to the upper end of said hollow pipe handle between said pipe and said hose.

* * * * *